United States Patent [19]

Heger et al.

[11] Patent Number: 4,875,503

[45] Date of Patent: Oct. 24, 1989

[54] STOP FOR COMPRESSOR PLATE VALVE

[75] Inventors: Werner Heger, Lehrte; Manfred Kramer, Barsinghausen; Heinrich Schlossarczyk, Wennigsen, all of Fed. Rep. of Germany

[73] Assignee: WABCO Westinghouse Fahrzeugbremsen GmbH, Hanover, Fed. Rep. of Germany

[21] Appl. No.: 190,565

[22] Filed: Apr. 29, 1988

[30] Foreign Application Priority Data

Jun. 30, 1987 [DE] Fed. Rep. of Germany ..... 3721464

[51] Int. Cl.[4] ..... F16K 15/14

[52] U.S. Cl. ..... 137/856

[58] Field of Search ..... 137/856, 516.19, 516.21; 251/284

[56] References Cited

U.S. PATENT DOCUMENTS

| | | | |
|---|---|---|---|
| 1,754,747 | 4/1930 | Feldbush . | |
| 2,118,356 | 5/1938 | Money . | |
| 2,908,287 | 10/1959 | Augustin | 137/856 |
| 3,926,214 | 12/1975 | Hrabal | 137/856 X |
| 4,168,722 | 9/1979 | Mayer | 137/856 X |

FOREIGN PATENT DOCUMENTS

| | | |
|---|---|---|
| 532353 | 8/1931 | Fed. Rep. of Germany . |
| 897191 | 2/1954 | Fed. Rep. of Germany . |
| 2133498 | 1/1972 | Fed. Rep. of Germany . |
| 2802378 | 8/1978 | Fed. Rep. of Germany . |
| 7928506 | 2/1981 | Fed. Rep. of Germany . |

*Primary Examiner*—Robert G. Nilson

*Attorney, Agent, or Firm*—J. O. Ray, Jr.

[57] ABSTRACT

A stop apparatus for a plate valve of a fluid compressor is provided. The stop apparatus is equipped with a wear-resistant insert so that the wear on some compressor components can be reduced.

17 Claims, 2 Drawing Sheets

STOP FOR COMPRESSOR PLATE VALVE

FIELD OF THE INVENTION

The present invention relates, in general, to plate valves in pneumatic compressors and, more particularly, this invention relates to an improved stop for a plate valve used in a pneumatic compressor environment.

BACKGROUND OF THE INVENTION

Prior to the present invention, a device having a stop for a plate valve used in an air compressor has been taught in the prior art. See, for example, German Pat. No. DE-AS 1 129 784, wherein plate valves, which are in the form of valve plates, which are fastened on one side thereof, are used in the opening and closing of the valve passages of an air compressor. In this prior art, in each case, the free end of each of the valve plates is moved against a stop.

The stop is located on various components such as the cylinder, the cylinder head, or a valve support. Due to the conventional manufacturing procedures that are used, these components of a pneumatic compressor usually consist of a castable material. Such castable material generally being either aluminum or gray cast iron. The problem is that the resistance of these materials against surface wear is relatively less than the wear resistance of the spring steel which is conventionally used in manufacturing a valve plate.

Furthermore, due to these different properties of the material used in manufacturing such valve plate and stop, the surface of the stop is subjected to added wear which in turn can lead to a detrimental deformation of such stop in a relatively short period of time, thereby causing added maintenance on such compressor. The added wear is primarily the result of an impact effect that is exerted by the valve plate on the stop in conjunction with a surface friction which occurs between the stop and the valve plate. Such surface friction between the stop and the valve plate occurs due to the fact that the elastic free end of the spring steel valve plate will bend when such valve plate hits the stop.

Additionally, the increase of the lift of the valve plate brought about by the surface erosion of the stop has the inherent disadvantage that the impact effect will gradually be increased. This gradual increase in the impact effect is due to the extension of the oscillation of such valve plate. Furthermore, the friction created between the stop and the valve plate increases simultaneously. This would be expected because the extending oscillation of the valve plate is associated with a more pronounced bending effect in the free end of the valve plate. All this means that the factors determining the wear, i.e., impact and friction, intensify in a disadvantageous manner with increasing wear and that, for this reason, such wear becomes progressively worse.

As would be expected by persons skilled in the pneumatic compressor art, an additional disadvantage of the increasing amount of lift of such valve plate lies in the delayed closure time of the valve openings, thereby decreasing the efficiency of such compressor.

For example, the delayed closure of the upstroke valve opening will result in a decrease of the output of the compressor. The reason for such reduced output of the compressor is that a portion of the air which was taken in can be recirculated into the suction portion of the compressor at the beginning of each compression stroke.

Aside from an unwanted impairment of the output of such compressor, the delayed closure of the pressure valve opening can also cause a detrimental increase in the thermal strain on the compressor since an already compressed, i.e., heated, pressurized air is permitted to flow back from the pressure area to the compression space at the beginning of each intake stroke of such pneumatic compressor.

Also noteworthy as one of the several problems associated with prior art stops is the increase of the lift of such valve plate. Such lift problem is caused by the surface wear of the stop and has the additional disadvantage that the risk of rupture at the root of the valve plate is enhanced.

It is conceivable to improve the resistance against wear of the stop surface through the use of appropriate tempering on surface hardening metallurgical techniques. Even though techniques of this kind would only have to be utilized in the area of the stop and not over the entire surface area of the component, including such stop, they would, however, require rather expensive manufacturing procedures, such as case hardening. Application of these techniques, therefore, would not be a cost-effective solution to the problem in a volume production arrangement of such components.

SUMMARY OF THE INVENTION

The present invention provides an improved stop for a valve plate in a pneumatic compressor in which such valve plate is fastened on one side thereof and has a free end which can move against a component of the compressor carrying the stop for such valve plate. According to this invention, an insert is provided that is secured to the component in the stopping area of the valve plate. This insert serves as the stop for the valve plate and is more resistant against wear than the component holding the insert.

OBJECTS OF THE INVENTION

It is, therefore, one of the primary objects of the invention to provide a stop for a valve plate in a pneumatic compressor that will have a significantly improved life due to improved resistance against wear.

Another object of the present invention is to provide a stop for a valve plate in a pneumatic compressor which will substantially limit the lift of such valve plate during operation of the compressor and thereby enhance the useful life of such valve plate.

Still another object of the present invention is to provide a stop for a valve plate in a pneumatic compressor which does not require costly manufacturing and assembly procedures for such compressor.

Yet another object of the present invention is to provide a stop for a valve plate in a pneumatic compressor which can be replaced if required at a relatively minor cost.

A further object of the present invention is to provide a stop for a valve plate in a pneumatic compressor which can be incorporated into an already existing compressor if desired.

An additional object of the present invention is to provide a stop for a valve plate in a pneumatic compressor in which conventional wear-reducing materials can be utilized for the manufacture of the stop.

Still yet another object of the present invention is to provide a stop for a valve plate in a pneumatic compressor which will improve the efficiency of the compressor after such compressor has been in service for some time.

In addition to the above-described objects and advantages of the present invention, various other objects and advantages of the stop for the valve plate of an air compressor will become more readily apparent to those persons skilled in the compressor art from the following more detailed description of the invention when such description is taken in conjunction with the attached drawing Figures.

BRIEF DESCRIPTION OF THE INVENTION

Figure 1:
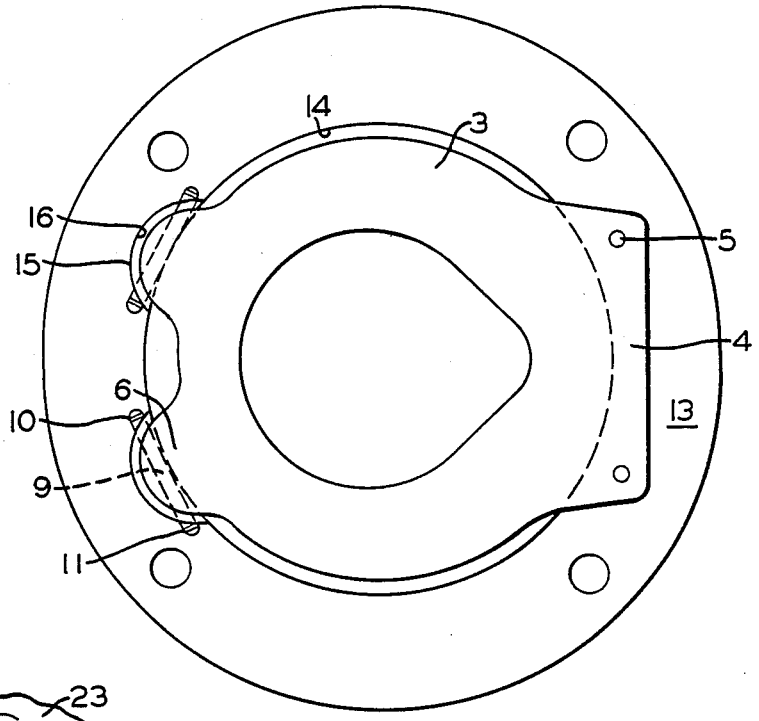
FIG. 1 is a top view which illustrates a valve plate with a stop for such valve plate positioned on a cylinder of a pneumatic compressor.

Prior to proceeding to a detailed description of the invention, it should be noted that throughout the several views of the drawings identical components have been identified with identical reference numerals for the sake of clarity.

Now refer more particularly to FIGS. 1 through 4 of the drawings. Illustrated therein is a cylinder 1 of an air compressor (not shown) for the generation of pressurized air. Such cylinder 1 has a cylinder cover which is in the form of a valve plate 2, for example. A valve plate 3 is provided which controls the valve openings by opening and closing. The valve plate 3 is inserted on its extreme outer end 4 between the cylinder 1 and the valve plate 2. The valve plate 3 is secured by fastening elements, such as pins 5, against horizontal displacement. The other extreme outer end 6 of the valve plate 3 serves as a stopping surface for a stop 7 that is attached to the cylinder 1.

As illustrated in FIG. 1, one portion of the surface of the stop 7 is equipped with an insert. Such insert is formed as a pin 9. In a presently preferred embodiment of the invention, such pin 9 may consist of the rolling element of a conventional rolling bearing or of a spring steel wire of any particular cross section.

The pin 9 is shown resting along substantially its full length in a cavity 8 that is located in the top wall of the cylinder 1. The extreme opposed ends 10 and 11 of the pin 9 are constructed in such a manner that such opposed ends 10 and 11 will protrude over a portion of the stopping area of the stop 7.

Figure 2:
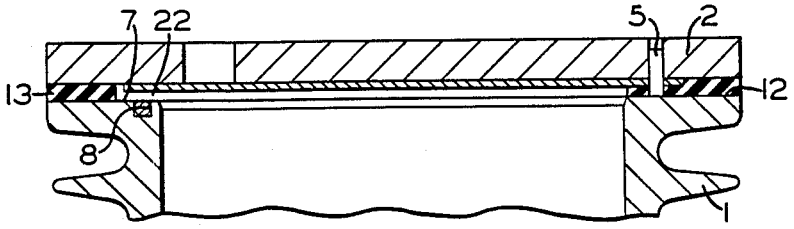
FIG. 2 is a fragmented cross-sectional view which illustrates a valve plate with a stop for such valve plate positioned on a cylinder of a pneumatic compressor.

As best seen in FIGS. 1 and 2, a ring-shaped seal 13 is provided against the front 12 of the cylinders 1 to serve the purpose of fastening the pin 9 to such front side 12 of the cylinder 1. Therefore, for this purpose, the seal 13 includes a slit 15 formed in its inner diameter 14. The slit 15 encloses a rim portion 16 adjacent the free end 6 of the valve plate 3. This occurs partially at a relatively small distance and in such a way that the area of the seal 14 which surrounds the slit 15 will substantially cover the extreme opposed ends 10 and 11 of the pin 9. That is the portion of such pin 9 which is not affected by the valve plate 3. As best seen in FIG. 2, the lateral side surface of the pin 9 is made flush with the front side.

Figure 3:
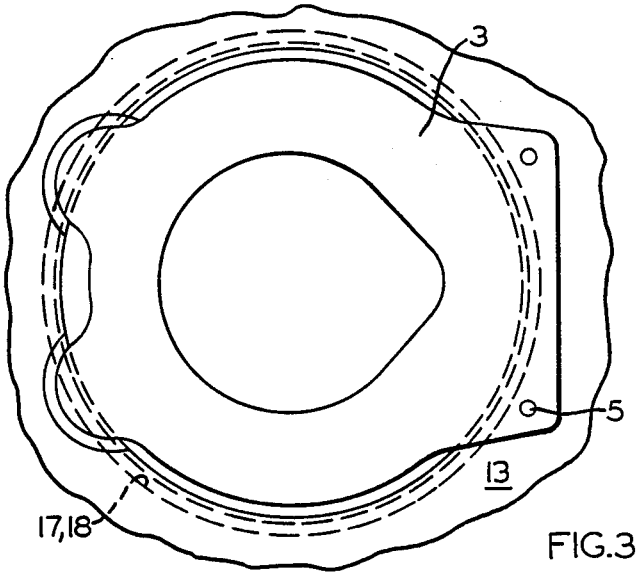
FIG. 3 is a fragmented top view which illustrates a valve plate with an alternative embodiment of a stop for such valve plate positioned on a cylinder of a pneumatic compressor.

Illustrated in FIG. 3 is an alternative embodiment of the invention utilizing a principle which is similar to that shown in FIG. 1. Here the insert consists of a ring 17 which rests in a cavity 18 formed in the front side of the cylinder 1 and which includes a lateral side surface that is flush with the front side 12 of the cylinder 1. In this embodiment, the ring 17 may be either an open or a closed ring. The portion of the ring 17 insert which is not affected by the valve plate 3 can be either entirely or partially covered by the seal 13. The cavity 18 is suitably formed by a ring-shaped groove that is cut into the front side 12 of the cylinder 1. In a presently preferred embodiment of this alternative insert, a conventional spring steel wire with any suitable cross section can be utilized for manufacturing such ring 17.

Figure 6:
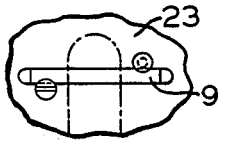
FIG. 6 is a fragmented top view which illustrates the presently preferred fastening means for securing a wear-resistant pin insert into position in a cavity formed in a component of a pneumatic compressor.
Figure 4:
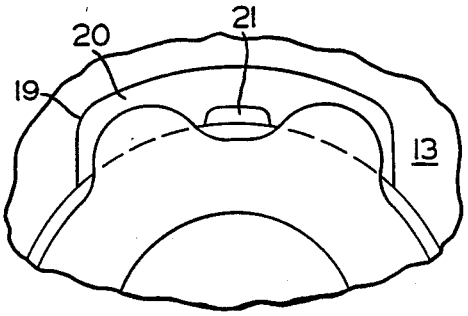
FIG. 4 is a fragmented top view which illustrates a valve plate with another alternative embodiment of a stop for such valve plate positioned on a cylinder of a pneumatic compressor.

Now refer more particularly to FIG. 4 which illustrates another alternative embodiment of an insert which consists of a plate 20. This plate 20 is preferably manufactured from a hardened steel. Similar to the insert shown in FIG. 1, the portion of the plate 20 insert which is not affected by the valve plate 3 may be either entirely or partially covered by the area of the seal 13 which surrounds the slit 15. In this embodiment, the plate 20 is fastened in place by means of an additional fastener 21, such as at least one positioning pin, or at least one screw, (FIG. 6) or even by shaping the cavity receiving the plate 20 in a particular manner.

In the embodiments shown in FIGS. 1 through 4 of the drawings, the lift of the valve plate 3 is determined by a gap 22, as shown in FIG. 2, which exists between the front side 12 of the cylinder 1 and the component 2 which blocks off such cylinder 1. It can be seen in FIG. 2 that the gap 22 is formed by the thickness of the seal 13. Furthermore, it is within the scope of the present invention for the slit 15 to be located in the component 2 blocking off the cylinder 1 as well. This would be particularly useful in those cases in which sealers are utilized that will not permit the formation of a suitable gap of this kind in the area of the stop 7. Such sealers being used between the front side 12 of the cylinder 1 and the component 2 blocking off such cylinder 1, for example.

Figure 5:
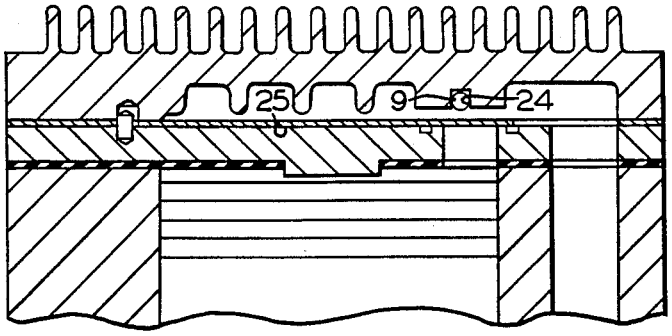
FIG. 5 is a fragmented side-elevation view partially in cross-section which illustrates a valve plate with a stop for such valve plate positioned on a cylinder head of a pneumatic compressor.

Reference is now made to FIG. 5 which illustrates yet another alternative embodiment of the present invention. In FIG. 5*a* cylinder head 23 is provided with an insert in the shape of a pin 9 which serves as a lift-limiting stop for the valve plate 25. In this embodiment, the pin can be secured in the desired position at the cylinder head 23 outside of the stopping area of the valve plate 25 by means of fasteners, such as, screws or rivits (FIG. 6*a*).

In the same manner, the plate 20 (FIG. 4) positioned adjacent the cylinder head 23 could serve as the stop for the valve plate 25, as well.

It is further within the scope of the present invention to place the pin 9 into a suitable cavity 24 formed in the cylinder head 23. The pin 9 is secured in the cavity 24 against dropping out by means of fasteners. The securing of the pin 9 into the cavity 24 could occur, for example, in the area of the pin 9 which is not affected by the valve plate 25 by means of caulking such cavity 24 receiving the pin 9. The pin 9 could also by suitably secured into the cavity 24 by shaping the cylinder head 23 in an appropriate manner.

While both a presently preferred and a number of alternative embodiments of the invention have been illustrated in the drawings and described in detail above, it should be obvious to those persons skilled in the fluid compressor art that other modifications and adaptations of the invention can be made without departing from the spirit and scope of the appended claims.

We claim:

1. A stop apparatus for a plate valve of a fluid compressor equipped with a valve plate, one side of said valve plate being fastened and a free end of said valve plate being movable against a component of said fluid compressor, said stop apparatus comprising a pin engageable with and inserted into a cavity formed in said component in a stopping area, said pin being inserted into said cavity in such a way that at least one portion of a length of said pin serves as a stop for said valve plate, said pin being more resistant against wear than said component engageable with said pin.

2. A stop apparatus, according to claim 1, wherein said component engageable with said pin is a cylinder.

3. A stop apparatus, according to claim 2, wherein said cylinder includes a cavity and said pin is positioned in said cavity along its length and is fastened in position by a fastening element.

4. A stop apparatus, according to claim 3, wherein said pin is inserted into a front side of said cylinder and a lateral side surface of said pin is flush with said front side.

5. A stop apparatus, according to claim 3, wherein said stop apparatus further includes:

(a) a ring-shaped seal which rests against a front side of said cylinder, said ring-shaped seal serves as a fastener for said pin which is inserted into said front side of said cylinder;

(b) said ring-shaped seal having a slit at an inner diameter thereof, an inner diameter of said slit encloses a rim portion of said free end of said valve plate at least partially at a small distance; and (c) an area of said ring-shaped seal surrounding said slit at least one of a partially and entirely covering a portion of said pin which is not affected by said valve plate.

6. A stop apparatus, according to claim 2, wherein said pin is inserted into a front side of said cylinder and a lateral side surface of said pin is flush with said front side.

7. A stop apparatus, according to claim 6, wherein said stop apparatus further includes:

(a) a ring-shaped seal which rests against a front side of said cylinder, said ring-shaped seal serves as a fastener for said pin which is inserted into said front side of said cylinder;

(b) said ring-shaped seal having a slit at an inner diameter thereof, an inner diameter of said slit encloses a rim portion of said free end of said valve plate at least partially at a small distance; and (c) an area of said ring-shaped seal surrounding said slit at least one of partially and entirely covering a portion of said pin which is not affected by said valve plate.

8. A stop apparatus, according to claim 2, wherein said stop apparatus further includes:

(a) a ring-shaped seal which rests against a front side of said cylinder, said ring-shaped seal serves as a fastener for said pin which is inserted into said front side of said cylinder;

(b) said ring-shaped seal having a slit at an inner diameter thereof, an inner diameter of said slit encloses a rim portion of said free end of said valve plate at least partially at a small distance; and (c) an area of said ring-shaped seal surrounding said slit at least one of partially and entirely covering a portion of said pin which is not affected by said valve plate.

9. A stop apparatus, according to claim 8, wherein said pin comprises:

(a) one of an open and a closed ring inserted into a ring-shaped cavity formed in said front side of said cylinder, said ring having a lateral side surface flush with said front side; and (b) a portion of said ring which is not affected by said valve plate is covered at least one of partially and entirely by said ring-shaped seal.

10. A stop apparatus, according to claim 9, wherein said ring consists of a conventional spring steel wire having any suitable cross-section.

11. A stop apparatus, according to claim 1, wherein said component engageable with said pin is a cylinder cover.

12. A stop apparatus, according to claim 11, wherein said cylinder cover includes a cavity and said pin is positioned in said cavity along its length and is fastened in position by a fastening element.

13. A stop apparatus, according to claim 11, wherein said pin is inserted into a front side of said cylinder cover and a lateral side surface of said pin is flush with said front side.

14. A stop apparatus, according to claim 11, wherein said pin is secured into position at said cylinder head by means of one of screws and rivets.

15. A stop apparatus, according to claim 1, wherein said component includes a cavity and said pin is positioned in said cavity along its length and is fastened in position by a fastening element.

16. A stop apparatus, according to claim 1, wherein said pin consists of a rolling element used in conventional roller bearings.

17. A stop apparatus, according to claim 1, wherein said pin consists of conventional spring steel formed into any suitable cross-section.

* * * * *